US006397019B1

(12) United States Patent
Kasuga

(10) Patent No.: US 6,397,019 B1
(45) Date of Patent: May 28, 2002

(54) IMAGE FORMING APPARATUS CAPABLE OF CONTROLLING TONER SUPPLY

(75) Inventor: Akihiro Kasuga, Niigata (JP)

(73) Assignee: Fuji Xerox Co., Ltd, Tokyo (JP)

( * ) Notice: Subject to any disclaimer, the term of this patent is extended or adjusted under 35 U.S.C. 154(b) by 0 days.

(21) Appl. No.: 09/661,781

(22) Filed: Sep. 14, 2000

(30) Foreign Application Priority Data

Sep. 21, 1999 (JP) ..... 11-267335

(51) Int. Cl.[7] ..... G03G 15/08

(52) U.S. Cl. ..... 399/27; 399/258

(58) Field of Search ..... 399/27, 61, 167, 399/258, 29

(56) References Cited

U.S. PATENT DOCUMENTS 5,287,151 A * 2/1994 Sugiyama ..... 399/258
5,587,770 A * 12/1996 Jo et al. ..... 399/258
5,790,917 A * 8/1998 Takura et al. ..... 399/27
5,790,918 A * 8/1998 Kunishi ..... 399/29
5,802,419 A * 9/1998 Sakurai et al. ..... 399/27 X

FOREIGN PATENT DOCUMENTS

JP 11-24513 1/1999

* cited by examiner

*Primary Examiner*—William J. Royer
(74) *Attorney, Agent, or Firm*—Whitham, Curtis & Christofferson, P.C.

(57) ABSTRACT

An image forming apparatus which can easily control toner supply without degrading compatibility of a toner cartridge in a low speed device and a high speed device, can control a toner amount in a developing portion avoiding feeding of the toner in excessive amount and whereby avoiding degradation of toner due to supply of excessive amount of the toner using a motor for image forming operation without requiring a dedicated motor for supplying toner. The image forming apparatus includes a hopper portion storing a toner, a mixer rotatably supported within the hopper portion, a developing portion provided adjacent the hopper portion and constituted of a developing roller and a toner layer restricting member, a photoconductor supplied the toner from the developing roller for performing developing, a charge roller for uniformly charging the surface of the photoconductor, a cleaner portion collecting a residual toner on the surface of the photoconductor and constituted of a cleaning blade and a waste toner collector, and a plurality of toner amount detectors provided in the developing portion at mutually different height positions.

20 Claims, 6 Drawing Sheets

IMAGE FORMING APPARATUS CAPABLE OF CONTROLLING TONER SUPPLY

BACKGROUND OF THE INVENTION

1. Field of the Invention

The present invention relates generally to an image forming apparatus. More particularly, the invention relates to an image forming apparatus for improving an image quality by controlling toner amount upon supplying with stirring a toner to be used for image formation in a printer, a facsimile machine or a copy machine employing an electrophotographic process using the toner.

2. Description of the Related Art

Conventionally, in an image forming apparatus employed in the printer, the facsimile machine, the copy machine or the like, a toner of fine particles is used as a developing agent. A toner cartridge filled with the toner is loaded within the image forming apparatus for feeding the toner consumed by development by means of toner stirring and feeding means to a developing portion. There is significant correlation between the toner and an image quality. Therefore, how to control the toner is an important factor to determine a quality of the image forming apparatus.

Therefore, as a technology for controlling a toner supply amount to the developing portion, there is a system for controlling the toner supply amount constant by controlling a rotation speed of a mixer.

A system for optimizing the toner supply amount to the developing portion at a constant amount by the rotation speed of the mixer encounters a problem. That is, the image forming apparatus includes a low speed apparatus and a high speed apparatus. If rotation speed of the mixer is set adapting to the low speed apparatus, the rotation speed of the mixer becomes excessive if applied to the high speed apparatus to supply an excessive amount of toner to the developing portion to cause degradation of the toner to cause defect in the image.

As a measure for this problem, there is a technology for optimizing toner amount to be supplied upon application for the high speed device, a gear train is modified to set the rotation speed of the mixer for feeding the toner at the same condition as the low speed device. However, in this case, specifications of the gear trains inherently become different between the low speed device and the high speed device to make it impossible to use the gear train in common between the low speed device and the high speed device. This results in increasing of kinds of parts to be a cause of cost-up.

On the other hand, as a technology for performing toner control, in Japanese Unexamined Patent Publication No. Heisei 11 (1999)-24513, a dedicated motor for supplying toner is provided for driving the stirring and feeding vane (mixer) to estimate a remaining amount of the toner by integrating a total operation period of the toner supply motor or by measuring a period required from starting toner supply to re-detection of presence of toner by a remaining amount sensor so that the toner supply period is set at a short period when the remaining amount of the toner in the toner cartridge is large, and the toner supply period is set at a long period when the remaining amount of the toner is small. Namely, in the disclosed technology, by employing a variable toner supply period, substantially a constant amount of the toner is discharged.

The system for controlling the toner supply amount constant by controlling the rotation speed of the mixer cannot make the components in common between the low speed device and the high speed device in the image forming apparatus to increase kinds of the parts to result in cost-up.

A technology for controlling the toner amount disclosed in Japanese Unexamined Patent Application No. Heisei 11-24513 estimates the remaining amount of the toner from the total operation period of the motor or the detected period of the remaining amount sensor for discharging the toner by determining the toner supply period on the basis of the remaining amount of the toner to make the toner supply amount substantially constant. However, this technology is not possible to control the toner amount in the developing portion finally influencing to the image quality.

Also, since the dedicated motor is provided for rotatingly driving the stirring and feeding vane (mixer) for supplying toner, the dedicated motor has to be controlled independently and asynchronous with image forming operation to make control complicate resulting in cost-up.

Summary of the Invention

An object of the present invention is to provide an image forming apparatus which can easily control toner supply without degrading compatibility of a toner cartridge in a low speed device and a high speed device, can control a toner amount in a developing portion avoiding feeding of the toner in an excessive amount and whereby avoiding degradation of toner due to supply of excessive amount of the toner using a motor for image forming operation without requiring a dedicated motor for supplying toner.

According to the first aspect of the present invention, an image forming apparatus comprises:

a hopper portion storing a toner;

a mixer rotatably supported within the hopper portion;

a developing portion provided adjacent the hopper portion and constituted of a developing roller and a toner layer restricting member;

a photoconductor supplied the toner from the developing roller for performing developing;

a charge roller for uniformly charging the surface of the photoconductor;

a cleaner portion collecting a residual toner on the surface of the photoconductor and constituted of a cleaning blade and a waste toner collector; and a plurality of toner amount detectors provided in the developing portion at mutually different height positions.

According to the second aspect of the present intention, an image forming apparatus comprises:

a hopper portion storing a toner;

a mixer rotatably supported within the hopper portion;

a developing portion provided adjacent the hopper portion and constituted of a developing roller and a toner layer restricting member;

a photoconductor supplied the toner from the developing roller for performing developing;

a charge roller for uniformly charging the surface of the photoconductor;

a cleaner portion collecting a residual toner on the surface of the photoconductor and constituted of a cleaning blade and a waste toner collector;

a motor to be rotational driving source for rotatingly driving the developing roller, the photoconductor and the mixer;

a first gear train transmitting rotational driving force of the motor to the developing roller and the photoconductor;

a second gear train transmitting rotational driving force of the motor to the mixer;

a first toner amount detector provided in the developing portion;

a second toner amount detector provided in the developing portion at an installation height different from that of the first toner amount detector;

a first toner amount control portion controlling the first toner amount detector; and a second toner amount control portion controlling the second toner amount detector.

The first gear train may consist of a first gear, a second gear, a third gear, a fourth gear, a photoconductor gear and a developer gear.

The second gear train may consist of a first gear, a second gear, a fifth gear, a sixth gear, a mixer driving gear and a mixer gear.

The fifth gear may have an electromagnetic clutch and has a two speed gear.

The first toner amount control portion may be connected to the electromagnetic clutch and controls the electromagnetic clutch.

The first toner amount detector and the second toner amount detector may be arranged in parallel to each other in opposition to the developing roller.

The first toner amount detector may be arranged at an upper side of the second toner amount detector.

The first toner amount detector and the second toner amount detector may be formed of a metal rod.

The first toner amount control portion may connect the electromagnetic clutch in response to a signal from the first toner amount detector for operating the second gear train for driving the mixer to rotate to stir the toner.

The second toner amount detector may detect presence or absence of toner in the hopper portion.

The second toner amount control portion may output a toner empty signal of the hopper portion in response to a signal from the second toner amount detector.

BRIEF DESCRIPTION OF THE DRAWINGS

The present invention will be understood more fully from the detailed description given hereinafter and from the accompanying drawings of the preferred embodiment of the present invention, which, however, should not be taken to be imitative to the invention, but are for explanation and understanding only.

In the drawings:

FIGS. 6A and 6B are illustrations of the major part of the preferred embodiment of the image forming apparatus according to the present invention, in which FIG. 6A shows a condition where an amount of toner in a developing portion is in normal condition, and FIG. 6B shows a condition where an amount of the toner in the developing portion is insufficient.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessary obscurity of the present invention.

Figure 1:
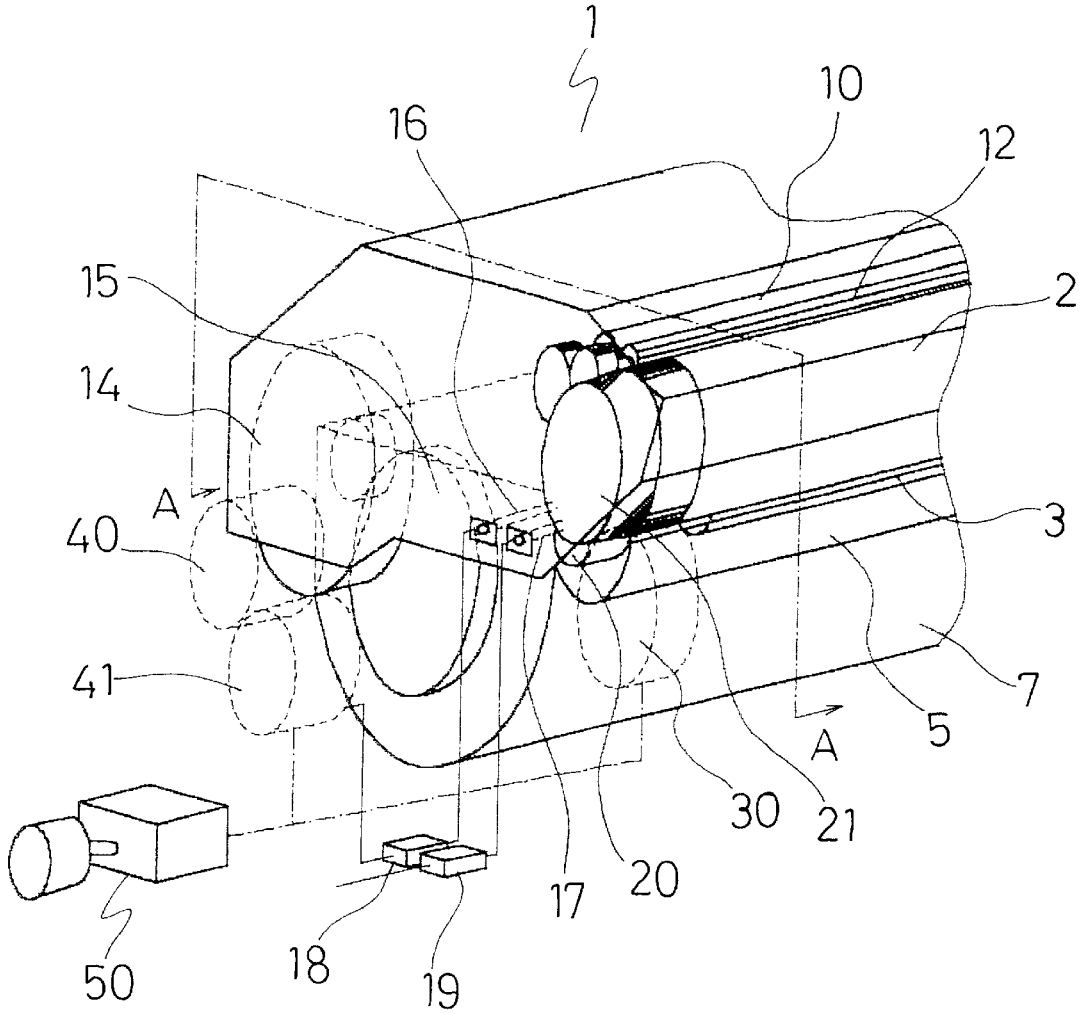
FIG. 1 is a perspective view showing a general construction of a major portion of the preferred embodiment of an image forming apparatus according to the present invention.
Figure 2:
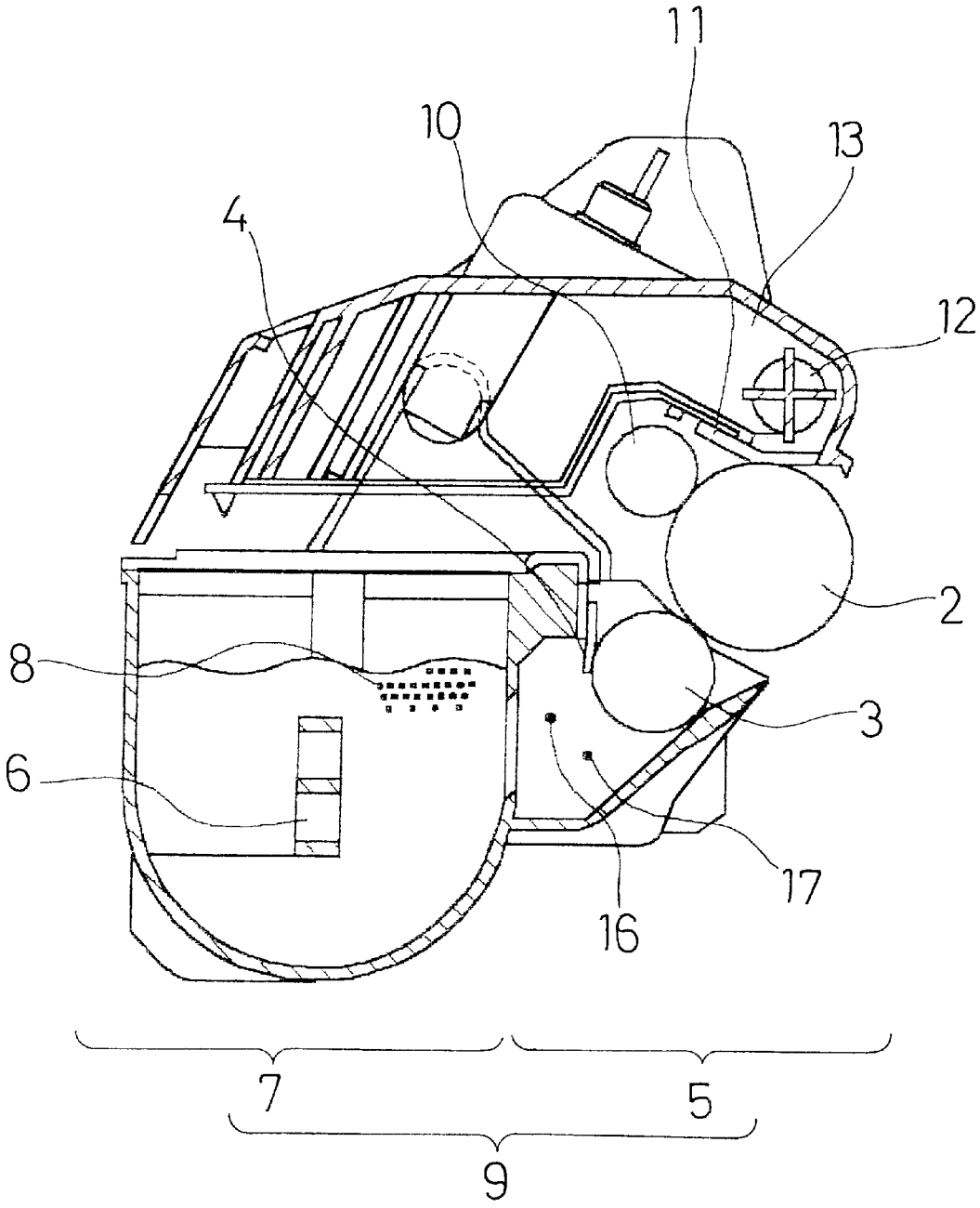
FIG. 2 a section taken along line A—A of FIG. 1.
Figure 3:
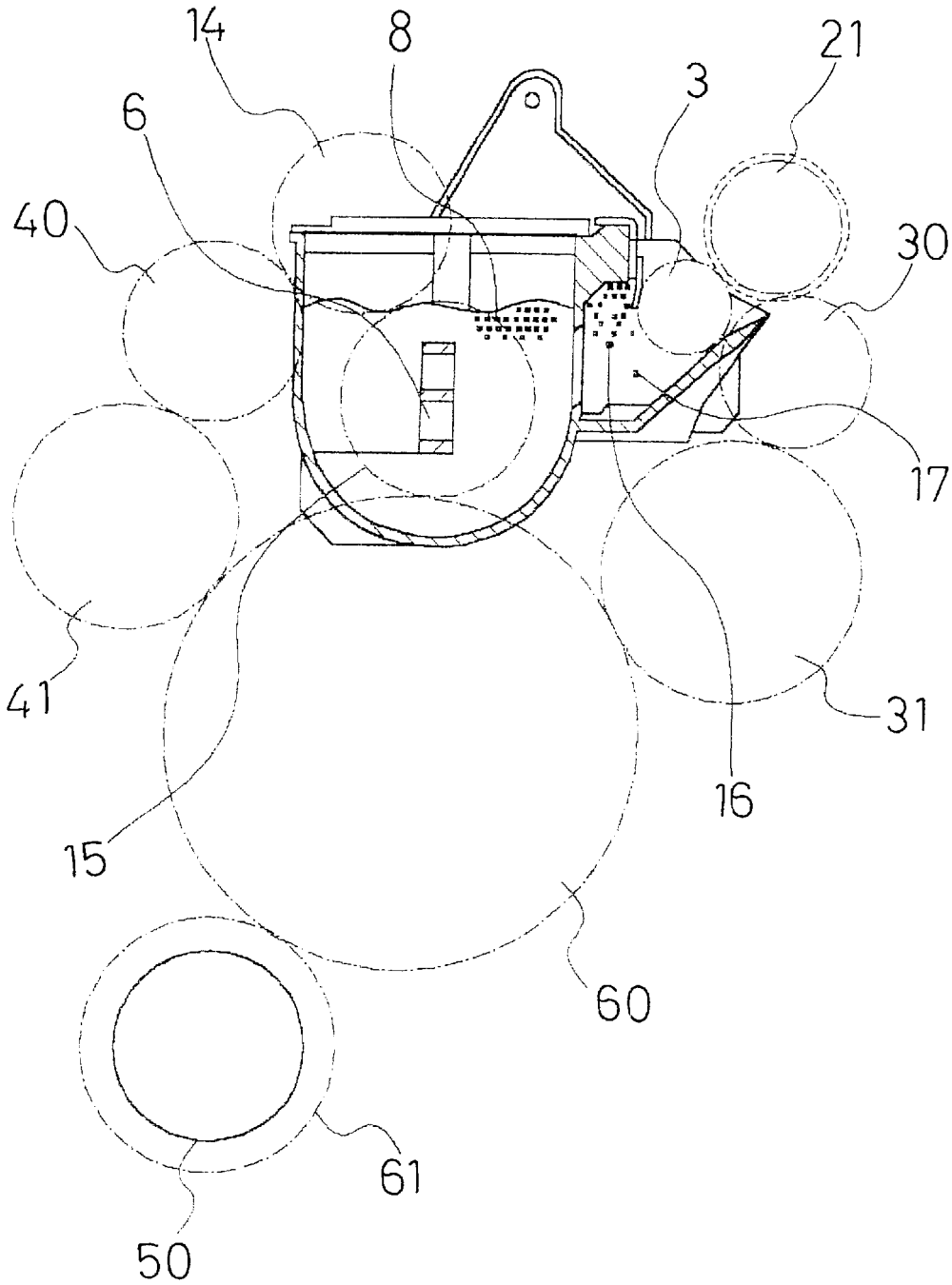
FIG. 3 is a sectional front elevation showing a partly omitted general construction of the major part of the preferred embodiment of the image forming apparatus according to the present invention.

FIG. 1 is a perspective view showing a general construction of a major portion of the preferred embodiment of an image forming apparatus according to the present invention, FIG. 2 is a section taken along line A—A of FIG. 1, and FIG. 3 is a sectional front elevation showing a partly omitted general construction of the major part of the preferred embodiment of the image forming apparatus according to the present invention.

Referring to FIGS. 1, 2 and 3, an image forming apparatus 1 is constructed with a hopper portion 7 storing a toner 8, a mixer 6 rotatably supported within the hopper portion 7, a developing portion 5 provided adjacent the hopper portion 7 and constituted of a developer roller 3 and a toner layer restricting member 4, a photoconductor 2 supplied a toner 8 from the developer roller 3 for performing development of a latent image formed thereof by an exposure light, a charge roller 10 uniformly charging the surface of the photoconductor 2, a cleaner portion 13 constituted of a cleaning blade 11 and a waste toner collector 12 for collecting a residual toner on the surface of the photoconductor 2, a motor as a rotational driving source of the developer roller 3, the photoconductor 2 and the mixer 6, a first gear train consisted of a first gear 61, a second gear 60, a third gear 31, a fourth gear 30, a photoconductor gear 21 and a developer gear 20 transmitting a rotational driving force of a motor 50 to the developer roller 3 and the photoconductor 2, a second gear train consisted of the first gear 61, the second gear 60, a fifth gear 41, a sixth gear 40, a mixer driving gear 14 and a mixer gear 15 for transmitting rotational driving force of the motor 50 to the mixer 6, a first toner amount detector 16 and a second toner amount detector 17 of a metallic rod form, arranged in parallel in opposition to the developer roller 3 within the developing portion 5 for detecting an amount of the toner 8, a first toner amount control portion 18 controlling the first toner amount detector 16 and a second toner amount control portion 19 controlling the second toner detector 17. The first toner amount detector 16 and the second toner amount detector 17 are installed at different height position in the developing portion 5. In the preferred embodiment, the first toner amount detector 16 is located at higher position than the second toner amount detector 17.

Next, operation of the preferred embodiment of the image forming apparatus constructed as set forth above, with reference to the drawings.

Referring to FIGS. 1, 2 and 3, when the motor 50 is driven to rotate, the first gear 61 and the second gear 60 are rotated. Since the second gear 60 is meshed with the third gear 31 and the fifth gear 41 to distribute the rotational driving force of the motor 50 to the side for transmitting to the developer roller 3 and the photoconductor 2 and to the side for transmitting to the mixer 6.

On the side of rotatingly driving the developer roller 3 and the photoconductor 2, rotational torque is transmitted through the first gear train in sequential order of the first gear 61, the second gear 60, the third gear 31, the fourth gear 30, the photoconductor gear 21 and the developer gear 20 for driving the developer roller 3 and the photoconductor 2 to rotate. On the other hand, on the side of rotatingly driving the mixer 6, rotational torque is transmitted through the second gear train in sequential order of the first gear 61, the second gear 60, the fifth gear 41, the sixth gear 40, the mixer driving gear 14 and the mixer gear 15 for driving the mixer 6 to rotate.

Figure 4:
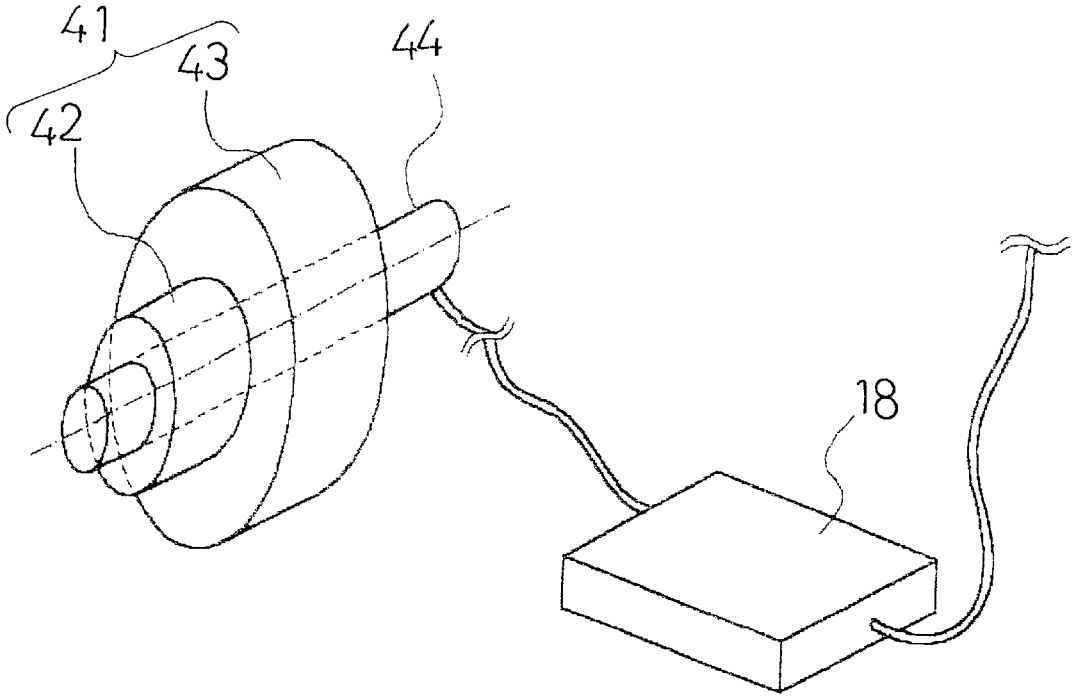
FIG. 4 is a perspective view showing a general construction of a fifth gear.

The fifth gear 41, as shown in FIG. 4, in the second gear train has a two speed gear construction consisted of a small gear 42 and a large gear 43, and has an electromagnetic clutch 44 connecting and disconnecting between the small gear 42 and the large gear 43. The small gear is meshed with the second gear 60 and the large gear 43 is meshed with the mixer driving gear 14. The electromagnet clutch 44 is connected to the first toner amount control portion 18 to be operated under control of the first toner amount control portion 18. By connecting the electromagnetic clutch 44, the small gear 42 of the fifth gear 41 and the large gear 43 are rotated together to transmit the rotational driving force of the motor 50 to the sixth gear 40, the mixer driving gear 14 and the mixer gear 15 for driving the mixer 6 to rotate.

Next, operation of the first toner amount detector 16 and the second toner amount detector 17 for detecting the amount of toner 8 in the developing portion 5 will be discussed hereinafter.

Figure 5:
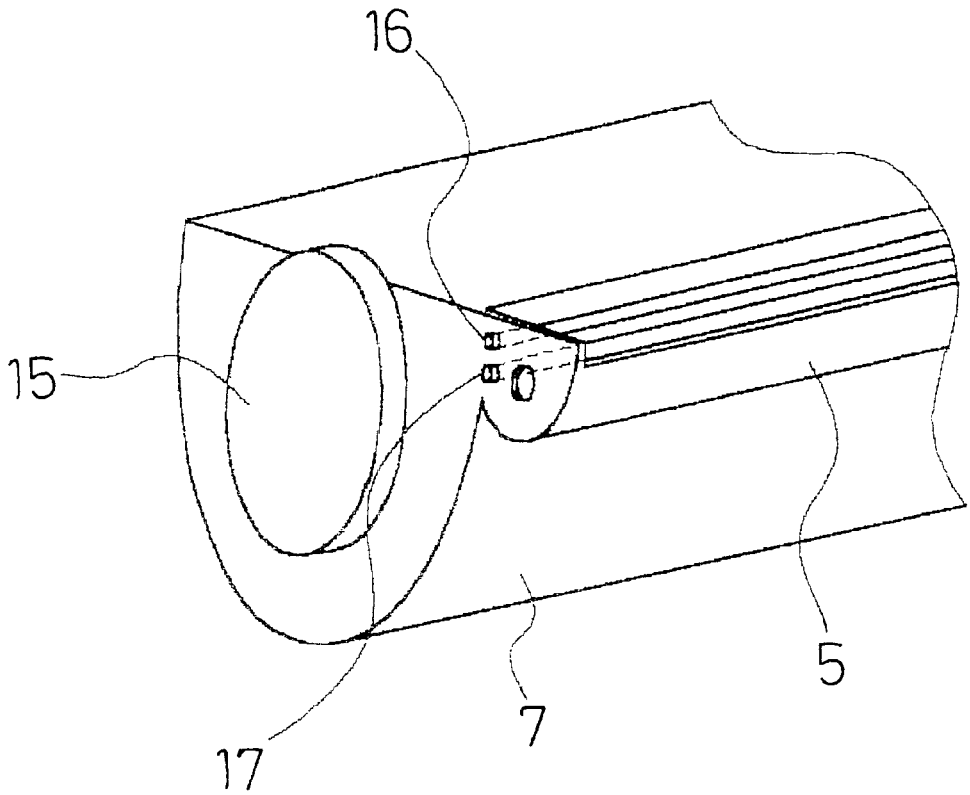
FIG. 5 is a perspective view showing a detail of the peripheral portion of a first toner amount detector and a second toner amount detector.
Figure 6A:
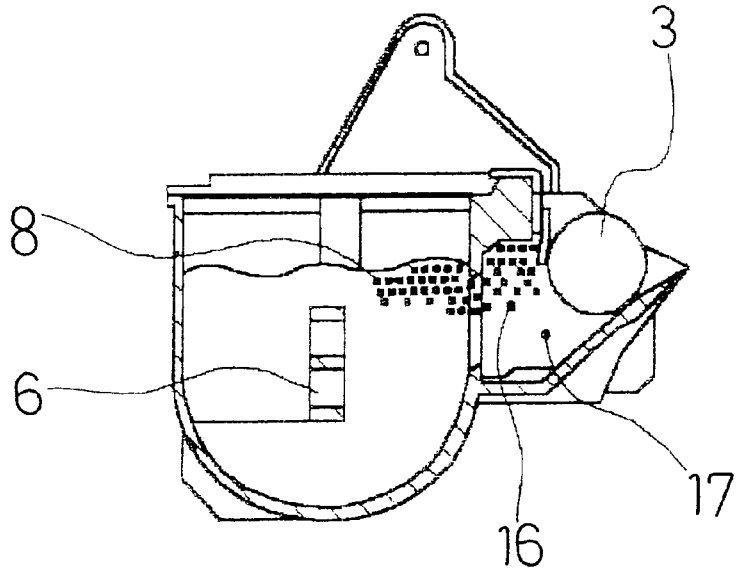
Figure 6B:
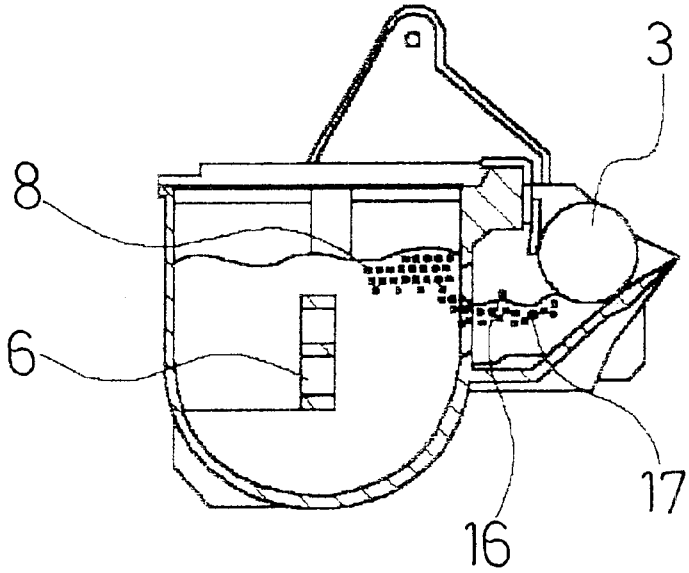

FIG. 5 is a perspective view showing a detail of the peripheral portion of a first toner amount detector 16 and a second toner amount detector 17, and FIGS. 6A and 6B are illustrations showing the condition of the amount of the toner 8 in the developer 9 comprising the hopper portion 7 and the developing portion 5.

Referring to FIGS. 1 to 3, 5, 6A and 6B, when the toner 8 is present between the first toner amount detector 16 and the developer roller 3, for presence of a magnetic body contained in the toner 8 as a component, the first toner amount detector 16 detects presence of toner by a weak current. When the toner amount in the developing portion 5 is small (condition shown in FIG. 6B) and thus, the current value becomes a value less than or equal to a predetermined current value (set current value of lacking of toner: corresponding an amount of toner 8 to cause defect in the formed image), an operation signal for connecting the clutch is fed to the electromagnetic clutch 44 in the fifth gear 41 by the first toner amount control portion 18 to drive the small gear 42 and the large gear 43 together to transmit the rotational driving force of the motor 50 to the sixth gear 40, the mixer drive gear 14 and the mixer gear 15 to finally rotate the mixer 6. By this, the toner 8 is supplied from the hopper portion 7 into the developing portion 5.

By supplying toner 8, when the toner amount in the developing portion 5 is increased (condition shown in FIG. 6A) and thus the detected current value becomes greater than or equal to a predetermined current value (normal amount of the toner of the set current value: greater value than the current value of lacking the toner 8, corresponding to the amount of toner 8 not causing in the formed image), an operation signal releasing the clutch is fed to the electromagnetic clutch 44 in the fifth gear 41 to cause free rotation of the large gear 43 so as not to transmit the rotational driving force of the motor 50 to the sixth gear 40 to stop rotation of the mixer 6.

When the amount of the toner 8 in the hopper portion 7 is decreased, the toner 8 cannot be supplied to the developing portion 5 by rotation of the mixer 6, and the amount of the toner 8 in the developing portion 5 is gradually decreased, the current value becomes less than or equal to the predetermined current value (set current value of toner empty) in the second toner amount detector 17. Thus, the second toner amount control portion 19 outputs a toner empty signal for the hopper 7 portion.

Accordingly, as set forth above, by detecting the amount of the toner 8 in the developing portion 5 by the first toner amount detector 16 to control the toner 8 from the hopper portion 7 to the developing portion 5 by rotation of the mixer, supply of the excessive amount of toner to the developing portion 5 can be successfully prevented. Therefore, degradation of toner 8 due to excess supply resulting in defect of the formed image can be successfully prevented.

On the other hand, by the second toner amount detector 17, presence and absence of the toner 8 in the hopper portion 7 can be detected. By the toner empty signal of the hopper output by the second toner amount control portion 19, presence and absence of the toner amount in the hopper portion 7 can be easily seen.

It should be noted that it should be obvious that comparable effect can be obtained even in the image forming apparatus using a magnetic two-component developing agent. Therefore, such image forming apparatus falls within a scope of the present invention.

As set forth above, the image forming apparatus according to the present invention is provided the first toner amount detector and the second toner amount detector in the developing portion at different heights, a toner amount in the developing portion and the presence and absence of toner in the hopper portion can be detected. Therefore, excessive supply of the toner into the developing portion can be avoided and degradation of toner due to excessive supply to cause defect of the image can be prevented. Also, presence and absence of the toner in the hopper portion can be easily detected. Also, since the toner supply operation and image forming operation are performed by the same motor, driving control can be facilitated.

Although the present invention has been illustrated and described with respect to an exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An image forming apparatus comprising:

a hopper portion storing a toner;

a mixer rotatably supported within said hopper portion;

a developing portion provided adjacent said hopper portion and constituted of a developing roller and a toner layer restricting member;

a photoconductor supplied said toner from said developing roller for performing developing;

a charge roller for uniformly charging the surface of said photoconductor;

a cleaner portion collecting a residual toner on the surface of said photoconductor and constituted of a cleaning blade and a waste toner collector;

a motor to be rotational driving source for rotatingly driving said developing roller, said photoconductor and said mixer;

a first gear train transmitting rotational driving force of said motor to said developing roller and said photoconductor;

a second gear train transmitting rotational driving force of said motor to said mixer;

a first toner amount detector provided in said developing portion;

a second toner amount detector provided in said developing portion at an installation height different from that of said first toner amount detector;

a first toner amount control portion controlling said first toner amount detector; and a second toner amount control portion controlling said second toner amount detector.

2. An image forming apparatus as set forth in claim 1, wherein said first gear train consists of a first gear, a second gear, a third gear, a fourth gear, a photoconductor gear and a developer gear.

3. An image forming apparatus as set forth in claim 1, wherein said second gear train consists of a first gear, a second gear, a fifth gear, a sixth gear, a mixer driving gear and a mixer gear.

4. An image forming apparatus as set forth in claim 3, wherein said fifth gear has an electromagnetic clutch and has a two speed gear.

5. An image forming apparatus as set forth in claim 4, wherein said first toner amount control portion is connected to said electromagnetic clutch and controls said electromagnetic clutch.

6. An image forming apparatus as set forth in claim 5, wherein said first toner amount detector is arranged at an upper side of said second toner amount detector.

7. An image forming apparatus as set forth in claim 6, wherein said second toner amount detector detects presence or absence of toner in said hopper portion.

8. An image forming apparatus as set forth in claim 1, wherein said first toner amount control portion is connected to an electromagnetic clutch and controls said electromagnetic clutch.

9. An image forming apparatus as set forth in claim 8, wherein said first toner amount control portion connects said electromagnetic clutch in response to a signal from said first toner amount detector for operating said second gear train for driving said mixer to rotate to stir said toner.

10. An image forming apparatus as set forth in claim 1, wherein said first toner amount detector and said second toner amount detector are arranged in parallel to each other in opposition to said developing roller.

11. An image forming apparatus as set forth in claim 10, wherein said first toner amount detector and said second toner amount detector are formed of metal rod.

12. An image forming apparatus as set forth in claim 10, wherein said second toner amount detector detects presence or absence of toner in said hopper portion.

13. An image forming apparatus as set forth in claim 1, wherein said first toner amount detector is arranged at an upper side of said second toner amount detector.

14. An image forming apparatus as set forth in claim 13, wherein said first toner amount detector and said second toner amount detector are formed of metal rod.

15. An image forming apparatus as set forth in claim 13, wherein said second toner amount detector detects presence or absence of toner in said hopper portion.

16. An image forming apparatus an set forth in claim 1, wherein said first toner amount detector and said second toner amount detector are formed of metal rod.

17. An image forming apparatus as set forth in claim 1, wherein said first toner amount control portion connects an electromagnetic clutch in response to a signal from said first toner amount detector for operating said second gear train for driving said mixer to rotate to stir said toner.

18. An image forming apparatus as set forth in claim 1, wherein said second toner amount detector detects presence or absence of toner in said hopper portion.

19. An image forming apparatus as set forth in claim 18, wherein said second toner amount control portion outputs a toner empty signal of said hopper portion in response to a signal from said second toner amount detector.

20. An image forming apparatus as set forth in claim 1, wherein said second toner amount control portion outputs a toner empty signal of said hopper portion in response to a signal from said second toner amount detector.

* * * * *